United States Patent [19]

Dubinsky

[11] Patent Number: 4,993,445

[45] Date of Patent: Feb. 19, 1991

[54] GARDEN UMBRELLA WITH SOLID WOODEN POLE DESIGNED TO OPERATE WITH HAND CRANK AND PULLEY SYSTEM

[76] Inventor: Emanuel Dubinsky, N.Y.

[21] Appl. No.: 568,065

[22] Filed: Aug. 16, 1990

[51] Int. Cl.[5] ..... A45B 11/00

[52] U.S. Cl. ..... 135/20 M; 135/20 R

[58] Field of Search ..... 135/20 M, 20 R, 22; 52/220, 720, 28; 114/90, 102, 112

[56] References Cited

U.S. PATENT DOCUMENTS

| | | | |
|---|---|---|---|
| 2,661,752 | 12/1953 | Kampf et al. | 135/20 M |
| 2,782,795 | 2/1957 | Small | 135/20 M |
| 2,951,492 | 9/1960 | Small | 135/20 M |
| 3,129,715 | 4/1964 | Militano | 135/20 M |
| 4,291,639 | 9/9181 | Burdick | 114/102 X |
| 4,424,824 | 1/1984 | Becher | 135/20 M |
| 4,567,907 | 2/1986 | Dubinsky | 135/20 M |
| 4,718,369 | 1/1988 | Pollard | 114/90 |
| 4,878,509 | 11/1989 | Tung | 135/20 M |
| 4,921,555 | 5/1990 | Skiff | 52/169.13 X |

FOREIGN PATENT DOCUMENTS

| | | | |
|---|---|---|---|
| 420312 | 8/1924 | Fed. Rep. of Germany | 114/90 |
| 6618373 | 7/1968 | Netherlands | 114/90 |

*Primary Examiner*—David A. Scherbel
*Assistant Examiner*—Lan Mai
*Attorney, Agent, or Firm*—Philip Young

[57] ABSTRACT

A solid wood pole garden umbrella is adapted to permit a hand crank and pulley system to slidably move a ribholder vertically along such wood pole for opening and closing the umbrella. A pulley wheel is mounted in the umbrella pole below its top portion, with one end of a pulley cord attached to the ribholder while the other end of the pulley cord extends through a narrow groove formed longitudinally along the side of the pole down to a lower pole portion where such pulley cord is operatively connected to the hand crank. The pulley cord is contained within the groove in the umbrella pole by a flexible plastic bead or rod which is snugly held or attached to the outer part of the groove to thereby provide a retainer for the pulley cord. The groove and retainer design enables the pulley and crank system to be employed in a solid wooden pole umbrella while maintaining the structural integrity of the pole and avoiding other designs where the pulley cord might interfere with the ribholder operation.

8 Claims, 2 Drawing Sheets

GARDEN UMBRELLA WITH SOLID WOODEN POLE DESIGNED TO OPERATE WITH HAND CRANK AND PULLEY SYSTEM

FIELD OF THE INVENTION

The present invention relates to garden umbrellas and, more particularly, to garden umbrellas of the solid wood pole type.

BACKGROUND ART

Garden umbrellas are generally large in size and, therefore, require special mechanical systems for opening and closing the umbrellas in as convenient and easy manner as possible. One commonly employed mechanical system involves a pulley and cord arrangement wherein a pulley wheel is mounted at the top of the umbrella pole with one end of the pulley cord attached to the umbrella ribholder for lifting the ribs during opening of the umbrella while the other end of the pulley cord is pulled downward by either direct hand manipulation or by a mechanical hand crank. In the U.S. Pat. No. 4,567,907 issued on Feb. 4, 1986 to Emanuel Dubinsky, the same inventor as the present patent application, there is disclosed a pulley system for opening and closing an umbrella by changing the position of a ribholder adapted for slidable movement along a solid wood umbrella pole. In such patent, a pulley wheel is mounted in the umbrella pole below its top portion with one end of a pulley cord fixedly attached to the ribholder while the other end of the pulley cord extends below the closed umbrella cover with two, spaced apart cord handles being adapted to be grasped by the operator for raising or lowering the ribholder to the required positions for opening or closing the umbrella. One of such pulley cord handles has a locking pin adapted for insertion into a hole in the umbrella pole for stopping the downward travel of the ribholder and supporting the umbrella in a fixed open position.

While the above described patented pulley system employing cord handles for manipulation of the pulley and umbrella are widely in use, there are also widely used the other type of pulley system having a hand crank mounted near the lower, middle portion of the umbrella pole. Here, in one arrangement, the pulley cord is connected internally through the inside of a hollow, umbrella pole to the hand crank mechanism which controls the pulley cord and, consequently, the opening and closing of the umbrella canopy. Generally, the hollow, umbrella pole is made of hollow aluminum since it provides the required strength while allowing the interio passage for the pulley cord to operate within as it extends from the hand crank mechanism up to the pulley wheel at the top of the pole. For various reasons, such as appearance or aesthetics, it is more desirable, or even required by the consuming public, to use a wooden umbrella pole. One example of this is the large market umbrellas that are constructed with wooden support ribs, a wood ribholder or runner notch and a matching wood pole. These market umbrellas have been made with solid wood poles and a pulley cord system having cord handles for operating the umbrella as described above with respect to the U.S. Pat. No. 4,567,907 to Emanuel Dubinsky. In some situations, it is desirable to have a wooden pole market umbrella that employs a hand crank mechanism. However, the manufacturing process to make a hollow wooden pole will become complex and costly, and most likely result in a pole having substantially reduced structural strength and rigidity which is inadequate to meet the requirements of the large outdoor umbrellas. One alternative to the hollow wood pole design is to connect the pulley cord between the hand crank mechanism and the top pulley wheel in a manner whereby the cord extends along the outside of the pole. This external cord arrangement can be cumbersome with the cord possibly interfering with the travel of the ribholder, or the cord becoming knotted or intertwined with other umbrella parts. Additionally, it is not visually appealing to have the external cord and hand crank combination, particularly when compared to having the pulley cord hidden from sight.

SUMMARY OF THE INVENTION

In view of the above, it is an object of the present invention to provide a garden umbrella having a wooden pole and a hand crank pulley cord mechanism, with the pulley cord being generally contained within the wooden pole and hidden from view. It is another object to provide a pulley cord system within a wooden pole garden umbrella wherein the wooden pole maintains the high strength and structural rigidity required of such garden umbrellas. It is another object of the present invention to provide a garden umbrella with the combination wooden pole and hand crank mechanism wherein the means for accommodating the cord within the wooden pole involves a simple and inexpensive process and design, without any significant loss of structural strength or rigidity of the pole. It is a further object of the present invention to provide a garden umbrella with a combination wooden pole and hand crank pulley mechanism that does not require that the pulley cord be mounted and operate external to the pole.

These and other objects are achieved by the present invention which provides a solid wood pole umbrella adapted to permit a hand crank and pulley system to slidably move a rib-holder vertically along the umbrella pole for opening and closing the umbrella canopy. A pulley wheel is mounted at the top of the umbrella pole with one end of a pulley cord attached to the rib-holder while the other end of such pulley cored extends through a narrow channel groove formed longitudinally along the side of the pole, from the pole top near the pulley wheel downwardly to a lower pole portion where the pulley cord is attached to the hand crank. The pulley cord is contained in the channel groove by a wall member comprised of either a plastic tube or bead, a snap-in strip, a filler material, or a plastic tubing surrounding the wood pole. The narrow channel groove and wall member retainer design enable the pulley and hand crank system to be employed in a solid wood pole umbrella while maintaining the structural integrity of the pole and retaining the pulley cord in the umbrella pole, out of the way and out of view.

DESCRIPTION OF THE PREFERRED EMBODIMENTS

Figure 1:
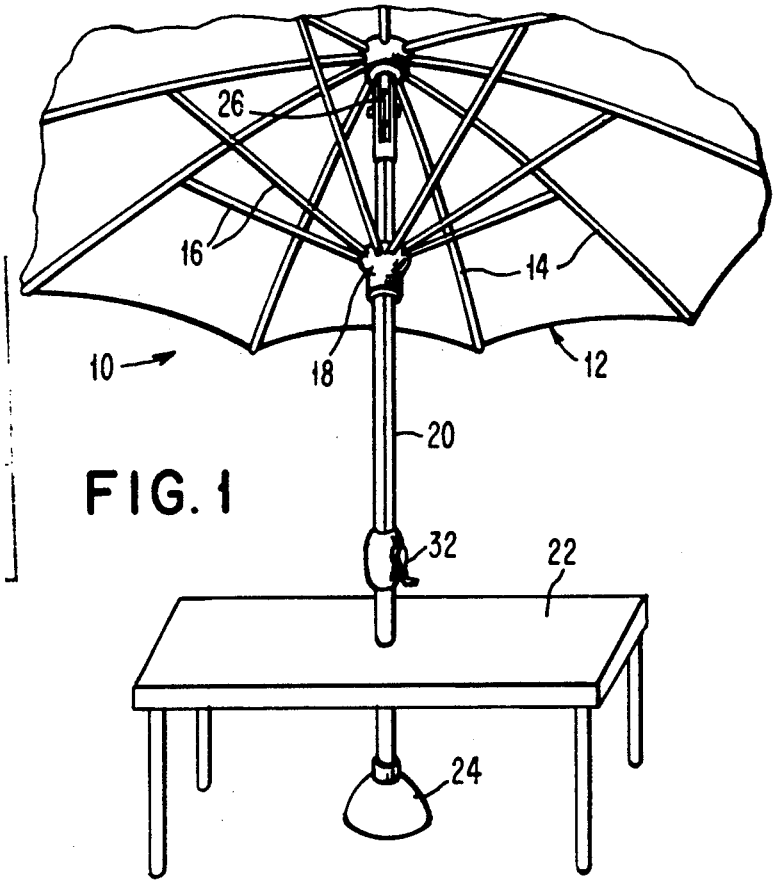
FIG. 1 is a perspective view of an overall umbrella system incorporating the wood pole specially adapted for the hand crank and cord pulley system, illustrative of the present invention.

Referring to FIG. 1, there is shown a table umbrella 10 having a canopy or cover 12 and a frame including ribs 14 for such canopy 12, support ribs 16 connected between such canopy ribs 14 and a runner notch or rib-holder 18, and a top rib-holder (not numbered) at the top of the umbrella pole 20 for pivotally supporting the ribs 14. The runner notch 18 supports the ribs 16 which are pivotally supported thereto, and such runner notch 18 is adapted to slide along the pole 20. The umbrella pole 20 is made of a solid wood material and extends through the top of a table 22 to a supporting floor base member 24. A pulley wheel 26 is incorporated in the pole 20 at the top portion thereof by means of its being mounted by a shaft 28 supported in a hollow pole section 30, located at the top of the pole 20 as shown in greater detail in FIGS. 2 and 3. The pole section 30 is a structurally rigid and high strength material, such as a hollow aluminum or plastic, and is secured to the pole 20 by a press fit, rivets or other suitable means, not shown.

Figure 2:
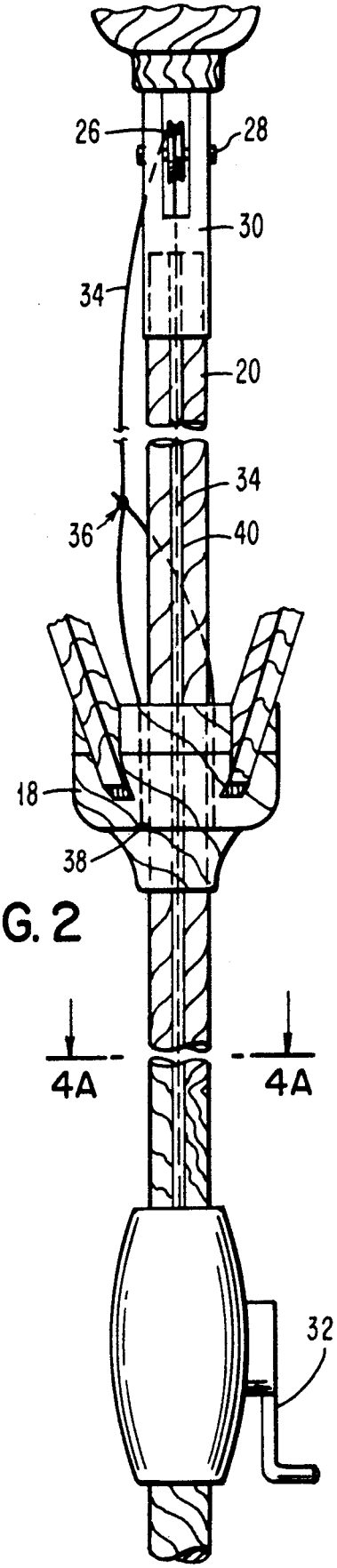
FIG. 2 is a close up elevation view of the umbrella pole with the hand crank and pulley system including the solid wood pole having the longitudinally extending channel groove adapted to contain the pulley cord therein.
Figure 3:
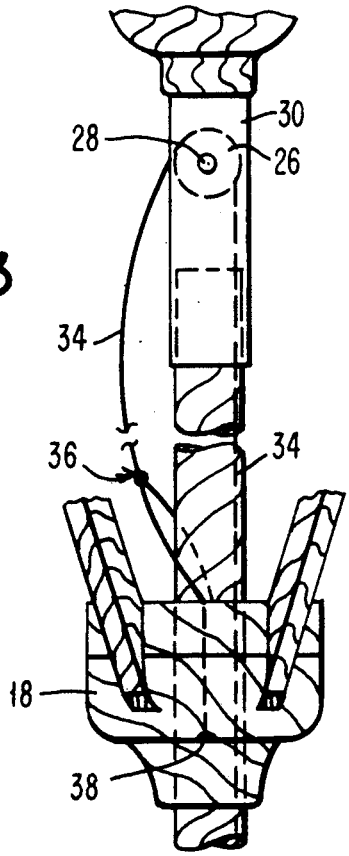
FIG. 3 is a close up view of a section of the umbrella pole taken at a different side view relative to the side view shown in FIG. 2, thereby depicting the location of the pulley cord and channel groove extending down the side of the pole.
Figure 4A:
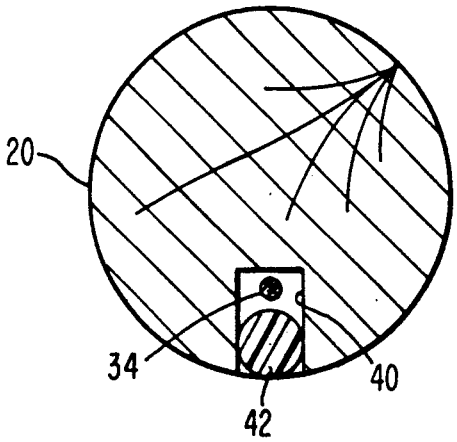
FIGS. 4A, 4B, 4C and 4D are transverse cross-sectional views taken through the pole and channel groove respectively of four separate embodiments of the channel groove and its side wall member for retaining the pulley cord in such channel groove, the FIG. 4A employing a plastic tubing wall member, the FIG. 4B employing a strip molding wall member; the FIG. 4C employing a U-shaped plastic snap-in wall member, and FIG. 4D employing a snapping strip wall member.
Figure 4B:
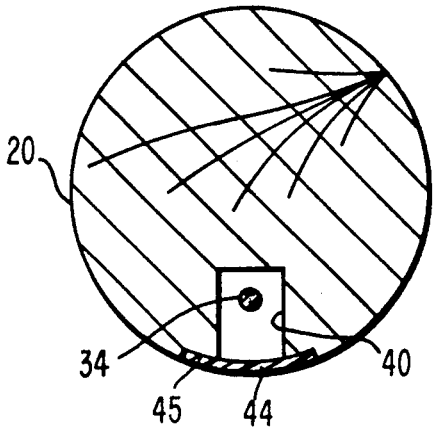
Figure 4C:
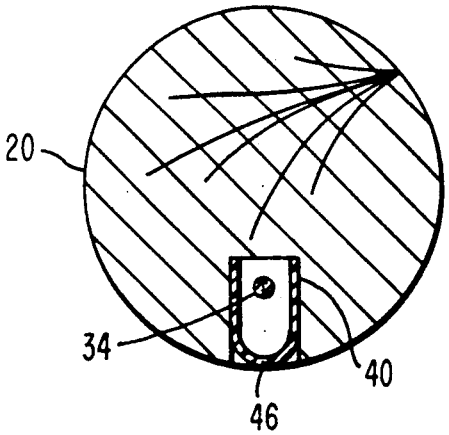
Figure 4D:
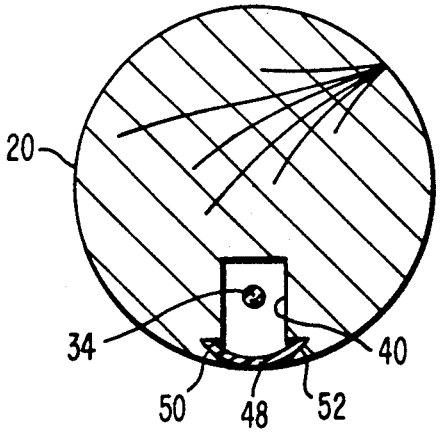

A hand crank 32 and its associated conventional crank mechanism, not shown, is mounted at the lower side of the pole 20, as shown in FIGS. 1-3. A pulley cord 34, made. for example, of a high strength nylon, has its lower end fixed or tied as shown at 36 onto the rib-holder 18, and such cord 34 extends around the pulley wheel 26 and continues down the pole 20 to where it terminates and connects to the hand crank 32. More specifically, the one end of the pulley cord 34 passes through a hole 38 extending through the runner notch 18 to enable it to be tied onto itself at 36 to thereby operate such runner notch 18 upward for opening the umbrella by the action of the hand crank 32.

As shown in FIG. 3, the pulley cord 34 extends straight down from the pulley wheel 26 through a narrow channel or groove 40 formed in the outside peripheral portion of the wooden pole 20 and extending longitudinally from the top of such pole at the pulley wheel 26 down to the lower part of the pole near the hand crank 32, as shown in FIG. 2. As shown in FIGS. 4A, 4B, 4C, 4D , FIGS. 5A, 5B and FIG. 6, several different types of side wall members may be employed to close off the channel groove 40 and retain the cord therein in a manner such that the pole retains its structural strength and integrity and the esthetic appearance of the wood pole 20 is maintained. In one embodiment shown in FIG. 4A a plastic or vinyl tubing 42, made of a flexible material, is press fitted into the channel groove 40 so that it permits a sufficient space for the pulley cord to operate while also providing the exterior wall surface and relatively smooth transition for the wood pole 20. If desired, the tubing 42 can be glued onto the walls of the channel groove 40 by any suitable adhesive. In another embodiment shown in FIG. 4B, the pulley cord 34 is retained in the channel groove 40 by means of a plastic strip molding 44 which is retained in a notch or groove 45 set into the pole at opposite sides of the channel groove 40 by an adhesive or by being press-fit therein. It is noted that the strip molding can be made of either plastic or a wood inset which is designed to match the exterior color and tone of the wood pole 20. In another embodiment shown in FIG. 4C, the wall member comprises an elongated U-shaped plastic snap in piece 46 which is retained by its own spring pressure in the channel groove 40. Also, the U-shaped wall member can, if desired, be glued onto the walls of the groove 40. In still another embodiment of the invention, the wall member comprises a wood or flexible plastic strip 48 which is adapted to snap into V-shaped notches 50 and 52 cut into the side walls of the wood pole 20 at the entrance to the channel groove 40. The notches 50 and 52 facilitate the access to the channel groove for purposes of installation of the pulley cord 34.

Figure 5A:
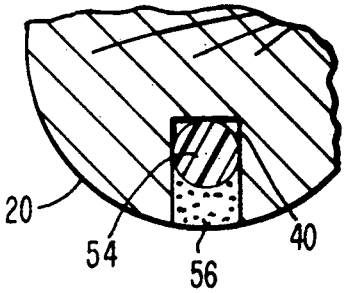
FIGS. 5A and 5B are fragmentary sectional views illustrating the steps for forming a filler material as the wall member for the channel groove in the umbrella pole.
Figure 5B:
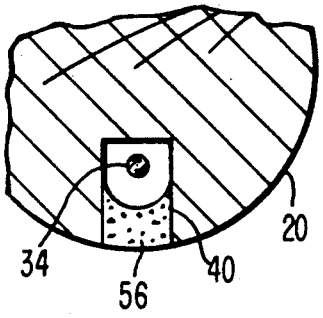

FIGS. 5A and 5B illustrate the steps of forming the wall member of the channel groove 40 from a wood filler material 56. First, a plastic backing rod 54 is placed int he channel groove 40 at a minimum depth which allows a wood filler, shown at 56, to form at the entrance to groove 40, as shown in FIG. 5A. After the wood filler 56 dries, the backing rod 54 is pulled in a longitudinal direction out of the groove 40 in a manner whereby the filler material 56 remains intact as the wall member. FIG. 5B shows the channel groove 40 after the backing rod 54 is removed and the pulley cord 34 is located in the groove for operation therein. It is noted that the filler material 56 forms a wall surface in alignment with the circumferential surface of the pole 20.

Figure 6:
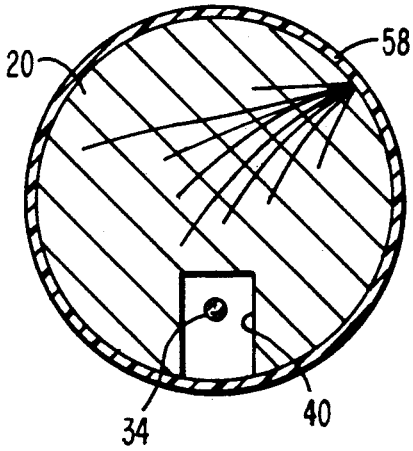
FIG. 6 is a transverse cross-sectional view taken through the umbrella pole and channel groove wherein the wall member of the channel groove is provided by a plastic tubing.

FIG. 6 shows still another embodiment of the present invention wherein the wall member for the channel groove 40 is comprised of a thin plastic shrink tubing 58 fitted around the pole 20 in a tight manner so as to retain the pulley cord 34 in the channel 40. The tubing 58 may be designed with a wood finish appearance to conform with the umbrella.

While the invention has been described above with respect to its preferred embodiments, it should be understood that other forms and embodiments may be made without departing from the spirit and scope of the present invention.

What is claimed is:

1. In an umbrella having an umbrella pole made of a solid rigid material, an umbrella cover, frame support ribs to support said umbrella cover and a rib-holder adapted for slidable movement along said umbrella pole, the improvement of which comprises:

a pulley wheel mounted in said umbrella pole below its top portion, a pulley cord having one end fixedly attached to said umbrella rib-holder, said pulley cord extending operatively around said pulley wheel and downward to a lower part of said umbrella pole, a hand crank attached near said lower part of said umbrella and connected to the other end of said pulley cord whereby said hand crank will raise or lower said rib-holder and umbrella cover through said pulley cord and pulley wheel;

said umbrella pole including a narrow groove formed along the side of said pole and extending longitudinally from the top portion of said pole near said pulley wheel down to the lower part of said pole near said hand crank, said groove having a width sufficient to contain said pulley cord therein and permit said pulley cord to move longitudinally therein, and cord retainer means extending along the open side of said groove adjacent the side of said pole, said cord retainer providing a closure for said groove to retain said cord in said groove and comprising a wall section for said pole for closing off said open side of said groove.

2. An umbrella as recited in claim 1, wherein said umbrella pole is made of wood comprising said solid rigid material.

3. An umbrellas recited in claim 1, wherein said cord retainer means comprises a flexible plastic material that is press fitted into said groove such that it permits sufficient space for said pulley cord to operate while also providing an exterior wall surface for said pole.

4. An umbrella as recited in claim 1, wherein said cord retainer means comprises a long plastic strip molding which is secured to the sides of said pole at the side of said groove for closing off said open side of said groove.

5. An umbrella as recited in claim 1, wherein said cord retainer means comprises a U-shaped plastic snap which is retained in said groove.

6. An umbrella as recited in claim 1, wherein said cord retainer means comprises a flexible plastic strip which is adapted to be secured to said pole by V-shaped notches in said wood pole at opposite sides of said groove.

7. An umbrella as recited in claim 1, wherein said cord retainer means comprises a filler material formed in said groove across said open side of said groove.

8. An umbrella as recited in claim 1, wherein said cord retainer means comprises a plastic shrink tubing fitted around the outside of said pole in a tight manner such that it retains said pulley cord in said groove.

* * * * *